United States Patent [19]

Matsumoto et al.

[11] 3,967,471

[45] July 6, 1976

[54] AUTOMATIC KNITTING YARN REPLACING APPARATUS

[75] Inventors: Fukuo Matsumoto, Heiwa; Teizi Okada, Aichi, both of Japan

[73] Assignee: Toray Textiles Inc., Tokyo, Japan

[22] Filed: Aug. 12, 1975

[21] Appl. No.: 604,068

[30] Foreign Application Priority Data

Feb. 2, 1973 Japan ..... 48-12939

Related U.S. Application Data

[63] Continuation-in-part of Ser. No. 437,352, Jan. 28, 1974, abandoned.

[52] U.S. Cl. ..... 66/161; 66/163; 57/80; 242/36

[51] Int. Cl.[2] ..... D04B 35/18

[58] Field of Search ..... 66/158, 160, 161, 163; 57/80; 242/36 R

[56] References Cited

UNITED STATES PATENTS

| | | | |
|---|---|---|---|
| 1,541,628 | 6/1925 | Crawford, Sr. | 66/160 |
| 2,055,610 | 9/1936 | Mishcon | 66/163 |
| 2,215,220 | 9/1940 | Lawson et al. | 66/163 |
| 2,383,838 | 8/1945 | Auble | 66/163 |
| 2,791,820 | 5/1957 | Spencer | 66/163 |
| 3,555,536 | 1/1971 | Ohayon | 200/61.18 X |
| 3,713,308 | 1/1973 | Levin | 66/163 |
| 3,726,113 | 4/1973 | Levin et al. | 66/163 |
| 3,795,120 | 3/1974 | Levin | 66/163 |
| 3,888,095 | 6/1975 | Philip | 66/163 |
| 3,902,675 | 9/1975 | Morton | 242/36 |

FOREIGN PATENTS OR APPLICATIONS

| | | | |
|---|---|---|---|
| 151,423 | 9/1920 | United Kingdom | 66/163 |

*Primary Examiner*—Mervin Stein
*Assistant Examiner*—A. M. Falik
*Attorney, Agent, or Firm*—Haseltine, Lake & Waters

[57] ABSTRACT

In a knitting machine in which upon the application of abnormal tension to yarn, the yarn is released from a yarn engaging element and simultaneously the knitting machine is halted. A yarn replacing apparatus is provided comprising at least one vertical motion mechanism for receiving yarn released from a yarn engaging element and moving it upward into reengagement with the yarn engaging element. The vertical motion mechanism further includes a detecting device for detecting an abnormal condition in the yarn, whereby when abnormal tension applied to the yarn has been removed, the vertical motion mechanism continues to operate, whereas when the abnormal tension applied to the yarn has not been removed, the vertical motion mechanism is halted, and the knitting machine automatically again comes into operation only after the reengagement of the released yarn with the yarn engaging element.

7 Claims, 7 Drawing Figures

AUTOMATIC KNITTING YARN REPLACING APPARATUS

CROSS-REFERENCE TO RELATED APPLICATION

This application is a continuation-in-part of application Ser. No. 437,352 filed Jan. 28, 1974, now abandoned.

BACKGROUND OF THE INVENTION

The present invention relates to knitting machines. More particularly, it relates to an automatic replacing apparatus for a knitting machine wherein a yarn released from a yarn engaging element is automatically placed into reengagement with the yarn engaging element.

Knitting machines are known in the art in which yarn engaging elements, e.g., so called stoppers are provided and yarn is fed to knitting needles through the stoppers or tripmechanism whereby when the yarn is placed under abnormal tension, the yarn is released from the stoppers and the knitting machine is stopped to prevent the occurrence of a "tight" or fault in the knitted fabric caused by the breaking of the yarn due to the abnormal tension applied to the yarn. The conventional stopper device of the above type is designed so that when abnormal tension is applied to yarn, the yarn is released from the stopper and simultaneously the knitting machine is stopped. Therefore, after checking the cause of the abnormality, the operator brings the yarn into reengagement with the stopper by a yarn replacing stick and then presses a button to bring the knitting machine into operation again. On the other hand, an analysis of the causes of the stoppage of the knitting machines by the conventional stoppers of the above described type showed that a majority of these stoppage were caused by the occurrence of abnormal tension due to tangling of filaments, napping, disorder in the traverse, knotting or the like, and the abnormal tension due to these causes were such that they did not usually result in the breaking of the yarn. Therefore, these causes were of the type that while the stopper would be brought into operation by a momentary abnormal tension, this abnormal tension would automatically disappear as the yarn was moved further, and the cases where it was necessary for the operator to effect adjustments or to change the yarn feed package accounted for few numbers of the total numbers of the stoppages of knitting machine.

Therefore, there has existed the need for an automatic replacing apparatus for a knitting machine of the above type, whereby when the knitting machine is stopped due to the occurrence of abnormal tension and when this abnormal tension spontaneously ceases to exist without interference by the operator, the yarn disengaged from the stopper is automatically placed into reengagement with the stopper.

DESCRIPTION OF THE PRIOR ART

Automatic yarn replacing apparatus of the above type are shown, for example, in U.S. Pat. No. 3,726,113 Levin et al, and U.S. Pat. No. 3,713,308 Levin and by Philip (The Knitting Times, Vol. 42, No. 16, Apr. 16, 1973). These prior art apparatus are all of the type in which the yarn is continuously engaged with the stopper while the automatic yarn replacing apparatus is in operation. In addition, these prior art replacing apparatus cannot be used with the conventionally used stoppers (e.g., the stoppers shown in British Pat. No. 716,549, etc.) and consequently the use of the conventional replacing apparatus makes it necessary to remove the conventional stoppers. Furthermore, their irregularity or fault detecting devices for detecting whether the abnormal tension applied to the yarn has been eliminated are relatively complicated in construction and their adjustments are also difficult.

On the contrary, the automatic yarn replacing apparatus according to the present invention is designed so that when abnormal tension is applied to yarn, the yarn is completely released from the stopper and this complete releasing of the yarn upon the application of abnormal tension has the effect of reducing detrimental effects on the yarn.

Further, the conventional stoppers of any type may be used as such with the apparatus of this invention and thus the apparatus of this invention is meritorious from a cost point of view. Still further, since the fault detecting device used in the apparatus of this invention is of a type which is operated electrically and very simple in construction, it is inexpensive to manufacture and is also positive and reliable in operation.

SUMMARY OF THE INVENTION

It is an object of the present invention to provide an automatic yarn replacing apparatus for a knitting machine of the type in which yarn is released from a yarn engaging element upon the application of abnormal tension to the yarn and the knitting machine is simultaneously stopped.

It is another object of the present invention to provide an automatic yarn replacing apparatus which is inexpensive to manufacture, simple to operate and free from the danger of producing any detrimental effect on the quality of the fabric.

It is still another object of the present invention to provide an automatic yarn replacing apparatus for a knitting machine of the above type comprising at least one vertical motion means for receiving yarn released from the yarn engaging element and moving the yarn upward into reengagement with the yarn engaging element, whereby the knitting machine is again brought into operation automatically upon the reengagement of the yarn with the yarn engaging element.

It is still another object of the present invention to provide an automatic yarn replacing apparatus wherein vertical motion means is provided with fault detecting means for detecting an abnormal condition in the yarn, whereby when the abnormal condition of the yarn has been eliminated, the operation of the vertical motion means is continued, whereas when the abnormal condition of the yarn has not been eliminated, the operation of the vertical motion means is stopped, and the knitting machine is automatically brought into operation again only after the released yarn has been reengaged with the yarn engaging element.

DESCRIPTION OF THE PREFERRED EMBODIMENT

The present invention will now be described in greater detail with reference to the illustrated embodiment.

Figure 1:
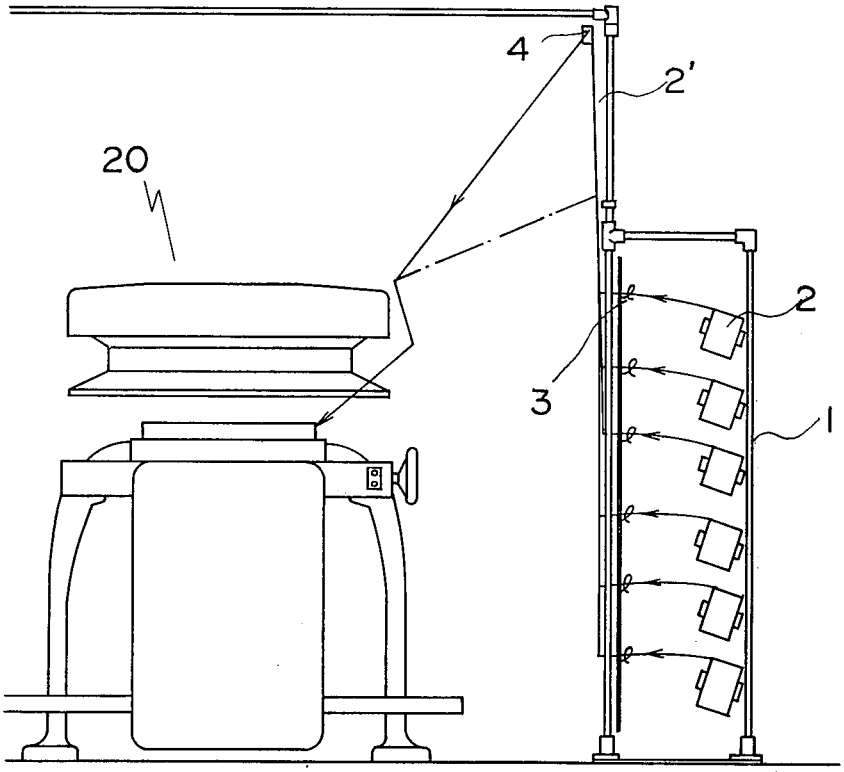
FIG. 1 is a side view of a conventional knitting machine useful in explaining the manner in which yarn is fed.
Figure 2:
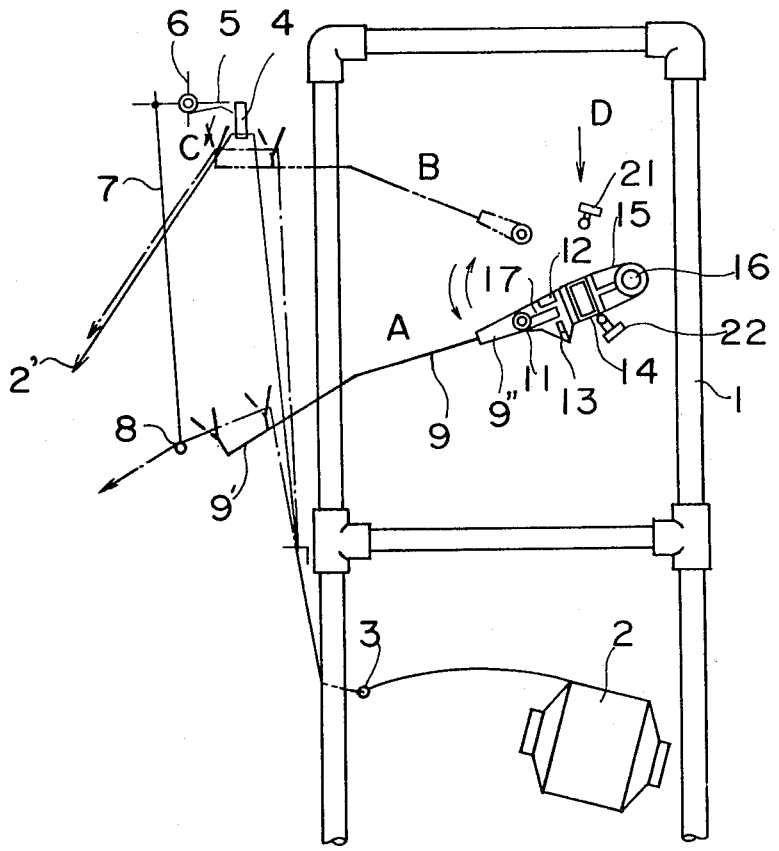
FIG. 2 is a schematic side view showing an embodiment of an automatic yarn replacing apparatus according to the present invention.

FIG. 1 shows the yarn feeding operation of a conventional knitting machine. In the normal condition of an operating knitting machine, a yarn 2′ taken from a yarn feed package 2 is fed as shown at an actual line in FIG. 1 in the direction of the arrow to a knitting machine 20 through a guide 3 secured to the lower portion of a creel 1 while it is being held in engagement with a stopper 4. When a tension greater than a certain value is applied to the yarn, the yarn is released from the stopper 4 and eventually the yarn falls to the position shown by the one-dot chain line in FIG. 1. Such stopper is entirely conventional and may be of the type shown, for example in British Pat. No. 716,549. The automatic yarn replacing apparatus of this invention is arranged to cooperate with the stoppers 4, with FIG. 2 showing a schematic side view of an embodiment of the apparatus, FIG. 3 a partial plan view of FIG. 2 and FIG. 4 a front view of FIG. 2.

Figure 5:
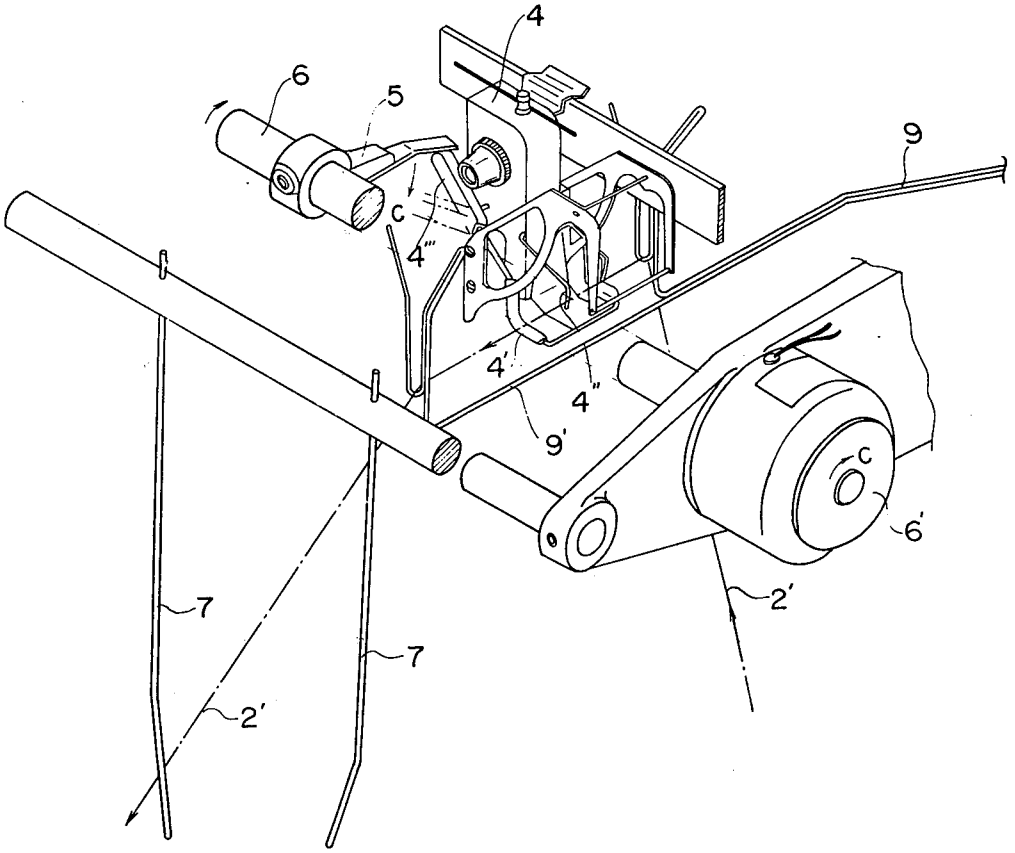
FIG. 5 is a schematic view of the apparatus of this invention which is useful in explaining the manner in which the yarn is brought into reengagement with the stopper.

In accordance with the present invention, each of the stoppers 4 is provided with a device shown in FIG. 5 for bringing the released yarn into reengagement with the stopper 4. This stopper is similar to the already known stopper shown in British Pat. No. 716,549 except a little modification in minor portion. Though the internal structure of the stopper 4 proper is not shown in FIG. 5, the stopper of the type having the internal structure disclosed in British Pat. No. 716,549 has heretofore been used widely and the stoppers of the type shown in this British Pat. No. 716,549 are also used in the illustrated embodiment of this invention. Said a little modification of this means that to operatively associate the stoppers 4 with the automatic yarn replacing apparatus of this invention, an extension 4‴ is provided on the opposite side of a yarn holding lever 4′ on the outside of the stopper proper and the electric wiring from the inside of the stopper proper is connected to the electric circuit of the automatic yarn replacing apparatus. FIG. 5 shows the condition in which a yarn 2′ which has been released from the stopper 4 is on the point of coming into reengagement with the stopper 4.

In the normal operating condition of the knitting machine, the yarn 2′ is fed to the knitting machine through the yarn holding lever 4′ with a sensing lever 4″ being supported by the yarn 2′. When an excessive tension is applied to the yarn 2′, the yarn holding lever 4′ of the stopper 4 is rotated downwardly (into a position lower than that of FIG. 5) against the force of the spring (not shown) provided inside the body portion of the stopper 4 and thus the yarn 2′ falls to release it from the stopper 4. The yarn 2′ released from the stopper 4 falls along a pair of guide elements 7 onto a guide bar 8 and it is then received as shown at the one-dot chain line in FIG. 2 by a yarn receiving element 9′ preliminarily arranged below the stopper 4 at position A in FIG. 2. As the yarn 2 disengages the yarn holding lever 4′ of the stopper 4, the sensing lever 4″ supported by the yarn 2′ is also rotated downwardly and thus the electrical contact is closed in the body portion of the stopper 4 to stop the knitting machine through an electromagnetic brake. Such electromagnetic brake is conventional as for example shown in British Pat. No. 716,549 and U.S. Pat. No. 1,541,628 and 2,055,610. When the sensing lever 4″ closes the electrical contact in the body portion of the stopper 4 so that the knitting machine is stopped through the electromagnetic brake constructed as will be described later, the automatic yarn replacing apparatus of this invention comes into operation. While the time required for the knitting machine to stop after the releasing of the yarn 2′ from stopper 4 is usually several seconds, the time differs dependent on the condition of the knitting machine. Therefore the length of the yarn knitted from the releasing of the yarn to stoppage of the knitting machine differs dependent on the conditions of the knitting machine. If the length of this knitted yarn is great, there is a danger of knitting the portion of the yarn put under abnormal tension. Therefore it is preferable to make the distance between the stopper 4 and the knitting section of the knitting machine as large as possible and adjustable. The reason for this will be apparent further on in the specification.

Figure 4:
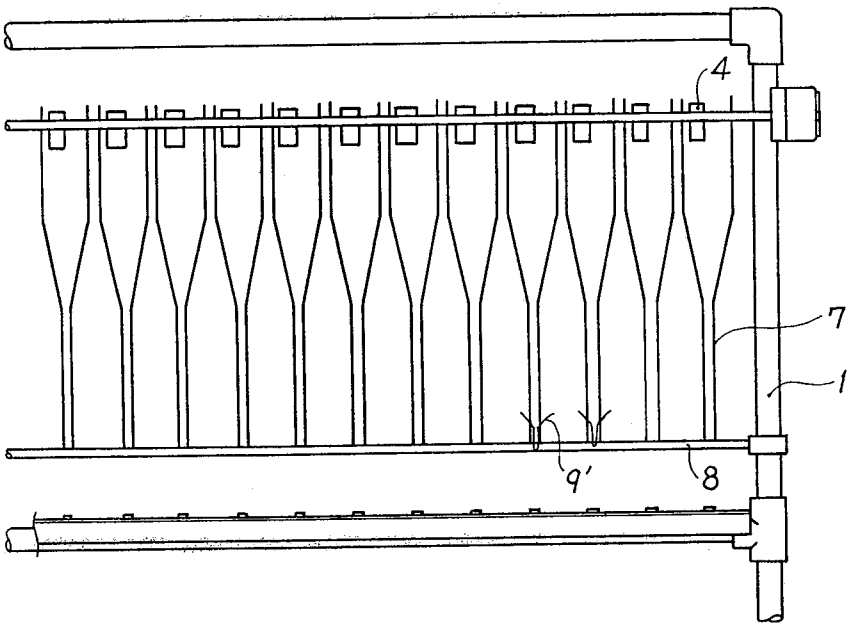
FIG. 4 is a front view of the apparatus in FIG. 2.

The purpose of the guide elements 7 is to ensure that the yarn 2′ released from the stopper 4 is positively guided to the yarn receiving element 9′, and the two guide elements 7 are arranged as shown in FIG. 4 on both sides of each yarn 2′ in such a manner that the guide elements 7 are out of contact with the yarn 2′ during the normal operation of the knitting machine. Further, the guide elements 7 may be eliminated, if the yarn 2′ released from the stopper 4 can be positively received by the yarn receiving element 9′. On the other hand, when the knitting machine stops operating in response to the closing of the electrical contact by the sensing lever 4″, the automatic yarn replacing apparatus of the invention is brought into operation by an electric circuit that will described later (the electric circuit shown in the schematic wiring diagram of FIG. 7 and constituting a part of the electrical motor drive circuit of the knitting machine).

Figure 3:
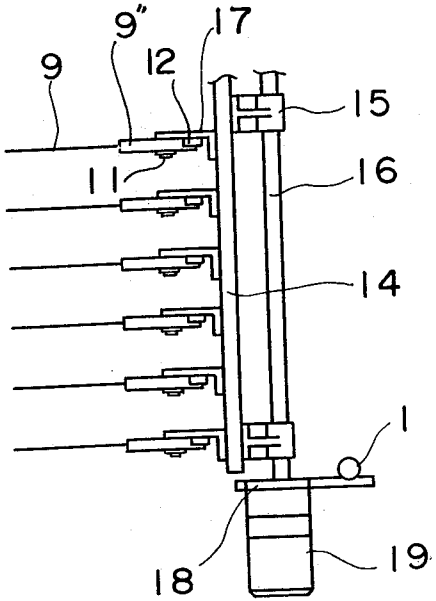
FIG. 3 is a partial plan view of FIG. 2 as viewed in the direction of arrow D.
Figure 6:
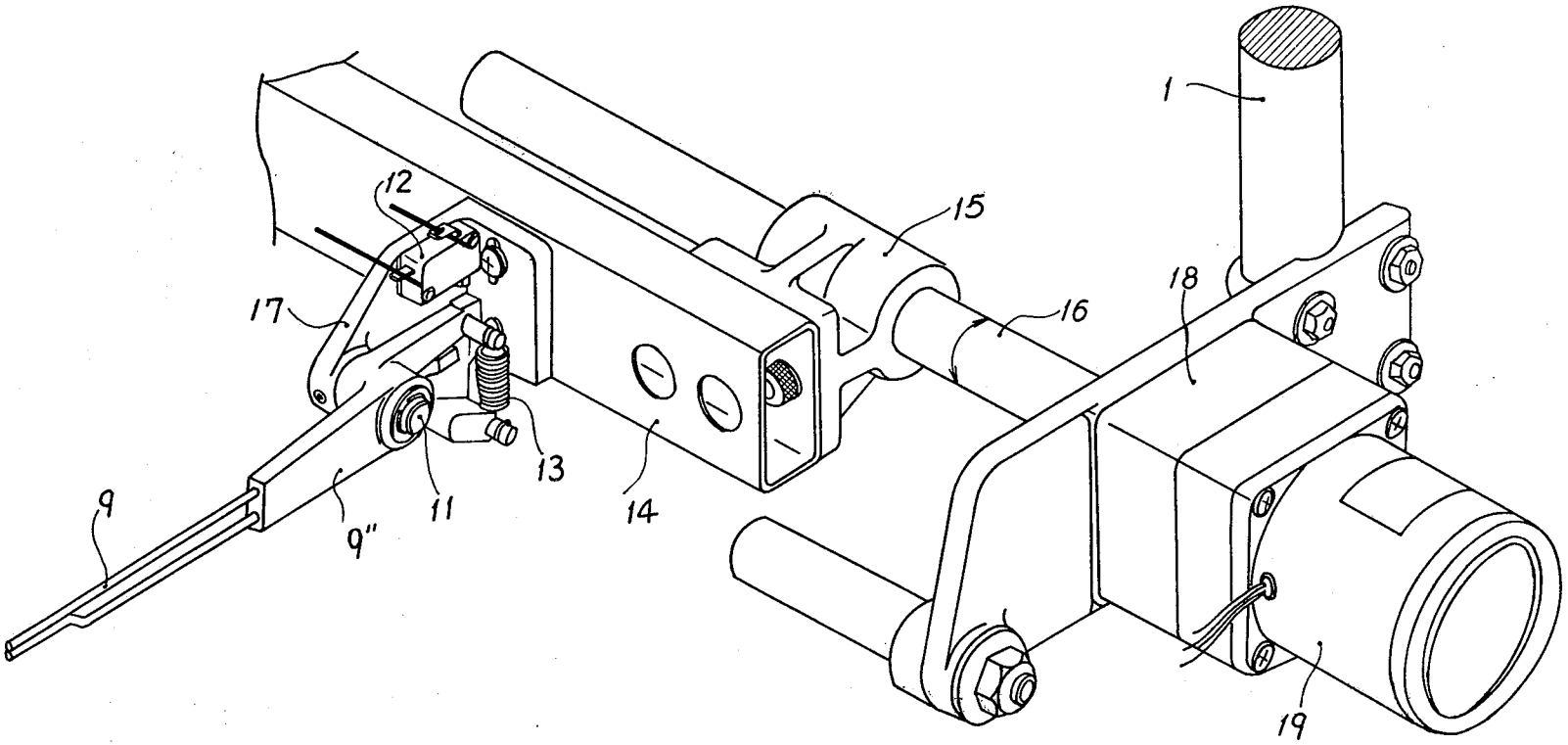
FIG. 6 is an enlarged front perspective view of a portion of the fault detecting means of the invention.

In other words, when the knitting machine stops operating and the yarn 2′ falls onto a yarn receiving element 9′, a driving motor 19 is brought into operation by a timer after the expiration of several seconds and a shaft 16 is rotated through a reduction gear (not shown) which is housed in a gear case 18 (See FIGS. 2, 3 and 6). The shaft 16 is integrally secured through a pair of brackets 15 to a rail 14 and a plurality of vertical motion members 17 mounted on the rail 14. An arm 9 is integrally secured to each of the vertical motion members 17, and the forward end of the arm 9 constitutes the yarn receiving element 9′ and the backward end of the arm 9 constitutes a tension sensitive arm 9″. Consequently, when the vertical motion members 17 are moved from the lower positions to the upper positions by rotating of shaft 16, the arm 9 with the yarn receiving element 9′ are simultaneously raised from their lower positions A to upper positions B as shown in FIG. 2. The position B corresponds to the positions of the yarn 2′ and the arm 9 which are shown by the two-dot chain lines in FIG. 2. FIG. 5 shows the relationship between the stopper 4 and the yarn receiving element 9' when the latter is at the position B. It is arranged so that when the arm 9 is moved to the position B, the rail 14 comes into contact with an upper limit switch 21 shown in FIG. 2. When the arm 9 is moved to the position B shown in FIGS. 2 and 5 so that the upper limit switch 21 operates, a solenoid 6' is energized and a shaft 6 is rotated in a direction of an arrow C thus rotating a stopper restoring lever 5 mounted on the shaft 6 in a downward direction. When this occurs, the stopper restoring lever 5 acts on the extension 4''' of the yarn holding lever 4' and the extension 4''' is rotated downwardly. Consequently, the extension 4''' is rotated from the solid line position to the two-dot line position shown in FIG. 5 so that the yarn holding lever 4' holds the yarn 2' and is rotated from its solid line position in FIG. 5 into a raised position at which the yarn holding lever 4' is held stationary by the spring in the stopper 4. (The raised position is not shown.) After the restoring lever 5 has acted on the extension 4''' of the yarn holding lever 4', the shaft 6 is rotated in the reverse direction and returned to the initial position by the spring in the solenoid 6'. When the yarn holding lever 4' holding the yarn 2' is held stationary at the raised position, the sensing lever 4'' is also rotated upwardly by the yarn 2' and the electrical contact in the body portion of the stopper 4 is opened again. Thereafter, in response to the operation of the upper limit switch 21, the driving motor 19 is rotated in the reverse direction by the timer and the arm 9 is returned to the position A from the position B. It is also arranged so that when the arm 9 returns to the position A, a lower limit switch 22 shown in FIG. 2 contacts with the rail 14 and the driving motor 19 is stopped by the lower limit switch 22, thus bringing the knitting machine into operation again. The angle of rotation of the vertical motion member 17 is dependent on the length of the arm 9, the position of the stoppers 4, etc., and it is usually less than 90 degrees. The rotational angle preferred for the operation of this embodiment is in the range between 30° and 60°.

Next, an embodiment of fault detecting means used with the present invention will be described with reference to FIG. 6 and FIG. 2. The fault detecting means is mounted on each of the vertical motion member 17 and it comprises the arm 9 having a yarn receiving element 9' and a tension sensitive arm 9'', a pin 11, a microswitch 12 and a spring 13. The tension sensitive arm 9'' is normally spaced from the microswitch 12. When abnormal tension applied to the yarn 2', causing it to be released from the stopper 4 and received by the yarn receiving element 9', has been eliminated, the tension sensitive arm 9'' is spaced from the microswitch 12 so that the microswitch 12 does not operate and the vertical motion member 17 continues its upward movement to replace the knitting yarn 2'. On the other hand, when the abnormal tension has not been eliminated even after the releasing of the yarn 2' from the stopper 4, the tension sensitive arm 9'' is rotated about the pin 11 against the force of the spring 13 to push against the pin lever of the microswitch 12 and actuate said microswitch. The output signal of the microswitch 12 stops the rotation of the shaft 16 to terminate the upward movement of the vertical motion members 17. In this way, the actuation of the fault detecting means causes the vertical motion members 17 to stop their movement on the way to the upper positions, thus warning the operator of the fault and the need to take necessary corrective steps.

Figure 7:
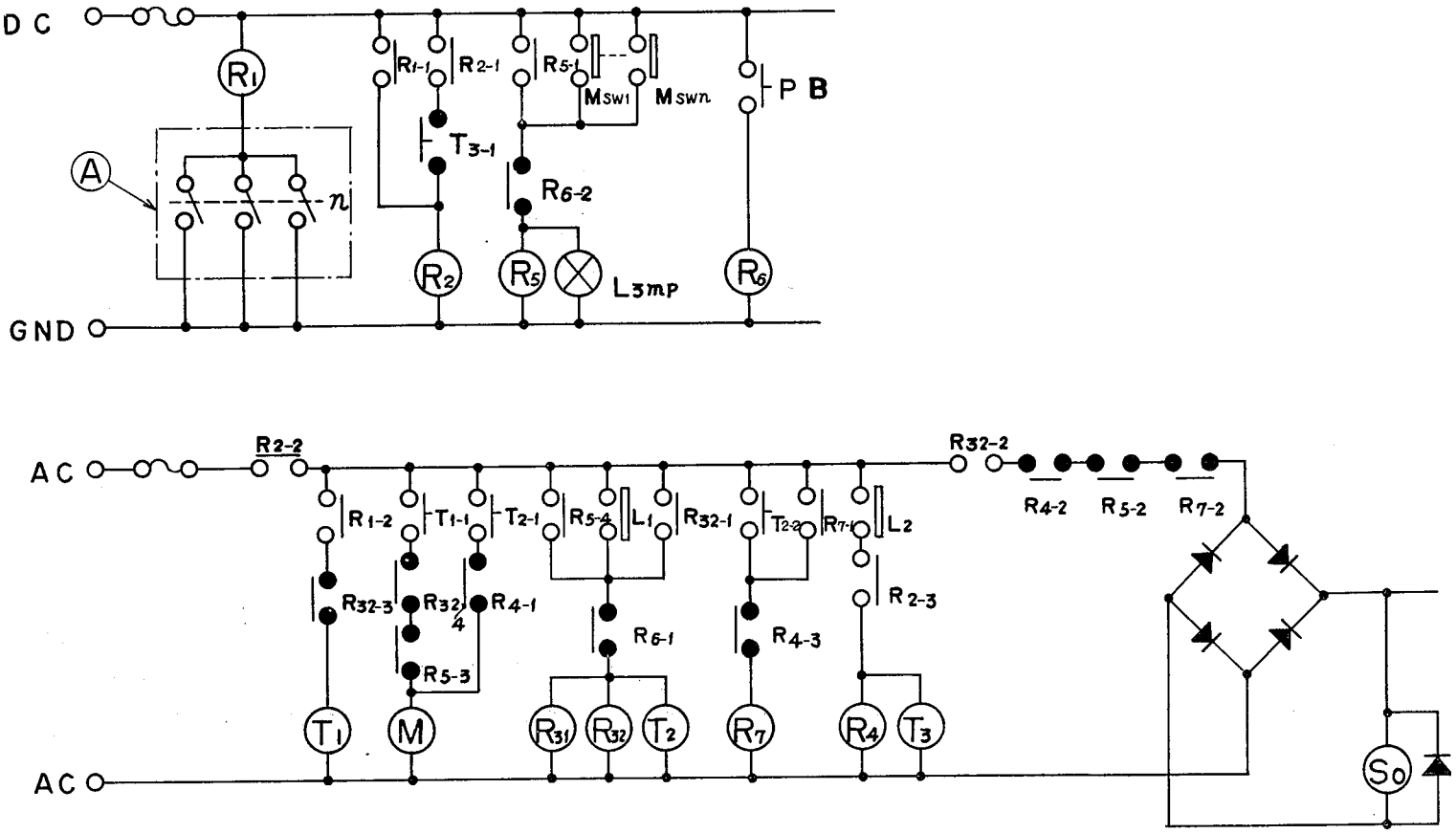
FIG. 7 is a circuit diagram showing an embodiment of an electric circuit of the apparatus according to the invention.

Having described so far the mechanism of the automatic yarn replacing apparatus of this invention, an embodiment of a control circuit for the apparatus of this invention will now be described with reference to FIG. 7. In the control circuit shown in FIG. 7, a section A includes a number of contacts for the stoppers 4 in the apparatus of the invention and the value of n varies depending on the number of yarns fed to the knitting machine. Reference characters $R_1$ et seq., designated relay coils, and $T_1$ et seq. designate timer relay coils. Reference characters $R_{1-1}$ et seq., and $T_{1-1}$ et seq., designate relay and timer relay contacts. Reference character M designates a driving motor relay, $L_1$ the upper limit switch 21 which operates when the vertical motion members 17 are moved to the position B, $L_2$ the lower limit switch 22 which operates when the vertical motion members 17 are moved from the positions B to the positions A. $M_{swl}$ through $M_{swn}$ designate the microswitches 12 provided in the fault detecting means mounted on the vertical motion members 17 to detect abnormal conditions in the yarns 2', and the same number of microswitches as the number of yarns fed to the knitting machine must be provided. Reference character Lamp designates a lamp which operates only when the microswitch 12 in the fault detecting means detects an abnormal condition in the yarn 2', namely the lamp is designed so that when it operates, the knitting machine remains at rest and the operator is warned of the abnormal condition in the yarn 2'. Designated at P·B is a push button which is pressed by the operator to bring the yarn into reengagement with the stopper 4 after the abnormal condition in the yarn has been eliminated, and $S_o$ designates the solenoid 6' which rotates the shaft 6 predetermined degrees in the direction C and which when de-energized is returned to the initial position under the action of the spring.

When abnormal tension is applied to the yarn 2', the control circuit operates as follows. Namely, when abnormal tension is applied to the yarn 2', the yarn 2' is released from the stopper 4 and received by the yarn receiving element 9'. When this occurs, the sensing lever 4'' of the stopper 4 is no longer supported by the yarn 2' so that the sensing lever 4'' rotates downwardly and the electrical contact in the stopper 4 is closed to energize the relay coil $R_1$. Consequently, the knitting machine is stopped through the contact $R_{1-3}$ (not shown) of the relay coil $R_1$. On the other hand, the relay coil $R_2$ is held in the energized condition by the contact $R_{1-1}$ of the relay coil $R_1$ and the holding contact $R_{2-1}$ of the relay coil $R_2$. An AC power supply is applied through the contact $R_{2-2}$ of the relay coil $R_2$ and the timer relay coil $T_1$ is energized through the contact $R_{1-2}$ of the relay coil $R_1$. At the expiration of about 2 to 3 seconds after the yarn releasing operation of the stopper 4, the timer relay coil $T_1$ closes the contact $T_{1-1}$. The contact $T_{1-1}$ of the timer relay coil $T_1$ energizes the driving motor relay coil M and thus the driving motor 19 rotates to move the vertical motion members 17 upward or toward the positions B. At the instant that the vertical motion members 17 are moved to the positions B, the upper limit switch $L_1$(21) which is arranged at a predetermined position comes into operation. The operation of the upper limit switch $L_1$(21) energizes the relay coil $R_{32}$ and the timer relay coil $T_2$. The relay coil $R_{32}$ is held in the energized condition by the contact $R_{32-1}$ and the upper limit switch $L_1$(21) so that the solenoid $S_o(6')$ is energized and rotated in the direction C to bring the yarn 2' into reengagement with the stopper 4 and the solenoid 6' comes to a rest after rotating the predetermined degrees. The solenoid 6' is operated on DC power rectified from AC power supply. The contact $R_{32-3}$ of the relay coil $R_{32}$ de-energizes the timer relay coil $T_1$. Also the driving motor relay M is de-energized through the contact $R_{32-4}$ and the contact $T_{1-1}$ of the timer relay coil $T_1$. It is arranged so that the driving motor reversing relay coil $R_{31}$ is energized simultaneously with the relay coil $R_{32}$ so that when the driving motor relay M is operated again, the driving motor 19 is rotated in the reverse direction. The timer relay coil $T_2$ is energized through the upper limit switch $L_1$(21). After the expiration of about 1 to 2 seconds, the driving motor relay M is operated through the contact $T_{2-1}$ of the timer relay coil $T_2$ and the driving motor 19 is rotated in the reverse direction to move the vertical motion members 17 from the position B toward the positions A. The contact $T_{2-2}$ holds the relay coil $R_7$ in the energized condition through the contact $R_{7-1}$ of the relay coil $R_7$. The solenoid 6'($S_o$) is de-energized through the contact $R_{7-2}$ of the relay coil $R_7$ held in the energized condition. When the vertical motion members 17 are moved back into the positions A, the lower limit switch $L_2$(22) comes into operation. The lower limit switch $L_2$(22) energizes the relay coil $R_4$. In this case, since the contact $R_{2-3}$ of the relay coil $R_2$ is in the closed position, the relay coil $R_4$ is energized. Consequently, the relay coil $R_4$ is designed so that it is energized only when the stopper 4 operates. The contact $R_{4-1}$ of the relay coil $R_4$ is designed to open the driving motor relay M in such a manner that the vertical motion members 17 are positively stopped at the positions A. The contact $R_{4-2}$ serves to prevent the solenoid circuit from operating erroneously, and the contact $R_{4-3}$ serves to open the holding circuit for the relay coil $R_7$. After the relay coil $R_4$ has been energized by the lower limit switch $L_2$(22), the timer relay $T_3$ is energized to open the holding circuit for the relay coil $R_2$. This means that the entire circuit is now in the same condition as under the normal operating conditions. This completes the operation of the control circuit for the time. Consequently, a start signal for the knitting machine may be generated from the contact $R_{4-4}$ of the relay coil $R_4$ which is not shown.

On the other hand, it is essential that the contact in the stopper 4 opens without fail when the yarn 2' is reengaged with the stopper 4 by the vertical motion member 17. If the contact remains closed, the knitting machine continues to stop operating. Where the yarn feed package 2 on the creel 1 runs out of the yarn 2' or when there is a break in the yarn 2', the vertical motion member 17 also operates in the same manner and the yarn holding lever 4' of the stopper 4 is restored into the original position thus completing the operation only for that once. However, since there is no yarn 2', the sensing lever 4'' is not raised by any yarn and the contact in the stopper remains closed thus holding the knitting machine in the non-operated condition.

Where the abnormal tension applied to the yarn 2' has not been eliminated, the electrical control circuit operates as follows. When, during the upward movement of the vertical motion member 17, the abnormal tension in the yarn 2' acts on and operates the abnormal tension sensing microswitch 12($M_{sw}$) so that the relay coil $R_5$ is energized and held in this energized condition through the microswitch 12 and the contact $R_{5-1}$ of the relay coil $R_5$. As a result of the holding of the relay coil $R_5$ in its energized condition the lamp (Lamp) connected in parallel with the relay coil $R_5$ is lighted to warn the operator of the irregularity. The energization of the relay coil $R_5$ opens the driving motor relay M through the contact $R_{5-3}$ of the relay coil $R_5$. Consequently, the rotation of the driving motor 19 is stopped and hence the movement of the vertical motion members 17 are stopped. When this occurs, the relay coil $R_{32}$ is held in the energized condition through the contact $R_{5-4}$. In this case, it is also arranged so that in the same manner as previously described, the driving motor 19 is rotated in the reverse direction when the driving motor reversing relay $R_{31}$ is energized and the timer relay coil $T_2$ is then energized. The timer relay coil $T_1$ is de-energized through the contact $R_{32-3}$. Since the solenoid 6' should not be energized in response to the energization of the relay coil $R_5$ and the relay coil $R_{32}$, the contact $R_{5-2}$ of the relay coil $R_5$ is provided to prevent the energization of the solenoid 6'.

After the abnormal tension in the yarn 2' has been detected by the abnormal tension sensing microswitch 12, the vertical motion member 17 is returned to the position A. In this case, as previously described, the knitting machine remains at rest since the contact in the stopper 4 remains closed.

When the operator depresses the push button P·B after the abnormal condition of the yarn has been eliminated, the vertical motion member 17 again holds the yarn 2' and brings it into reengagement with the stopper 4. In this case, the relay coil $R_6$ is energized in response to the depression of the push button P·B. Consequently, the contact $R_{6-1}$ of the relay coil $R_6$ is opened to open the holding circuit for the relay coil $R_{32}$ and at the same time the holding circuit for the relay coil $R_5$ is opened through the contact $R_{6-2}$, thus causing the lamp (Lamp) to go off. Consequently, the initial condition is restored, namely, the condition is restored which was existing when the contact in the stopper 4 was first closed. As a result, the relay coil $R_1$ is energized and the vertical motion member 17 is moved from the position A to the position B to bring the yarn 2' into reengagement with the stopper 4 in the same manner as mentioned earlier. After the yarn 2' has been reengaged with the stopper 4 by the vertical motion member 17 at the position B, the vertical motion member 17 is returned from the position B back into the position A in the manner mentioned previously and the knitting machine resumes its normal operation.

As will thus be seen from the foregoing description that an automatic replacing apparatus according to the present invention provides a mechanized knitting yarn replacing operation which has heretofore been carried out manually, and this has a very great benefical effect on the efficiency of production and the operation efficiency. It will further be seen that the simple construction of this automatic replacing apparatus enables it to be manufactured at a low cost and ensures greater reliability in performance. Moreover, it will be apparent that the use of fault detecting means ensures that no yarn under abnormal tension is forcibly replaced and that the occurrence of phenomena having a detrimental effect on the quality of the fabric such as a, "tight" or the breaking of yarn are completely prevented.

What is claimed is:

1. On a knitting machine having yarn engaging means which releases engaged yarn and stops the knitting machine when the yarn is subjected to abnormal tension, an improved automatic yarn replacing apparatus comprising at least one yarn receiving means disposed below the yarn engaging means under normal condition without contacting the yarn, and means (a) for moving said yarn receiving means upwardly when the yarn engaging means releases the yarn such that said yarn is captured and is brought into reengagement with said engaging means and returning said yarn receiving means downwardly after said reengagement is completed, and (b) for actuating yarn support elements of said yarn engaging means when the yarn receiving means is raised to a position that is suitable for said reengagement of the yarn with the engaging means.

2. An apparatus according to claim 1, further comprising fault detecting means coupled with said means for moving said yarn receiving means to stop upward movement of said yarn receiving means when the yarn is still under abnormal tension.

3. An apparatus according to claim 1 wherein said yarn receiving means comprises a pivotal arm including a yarn receiving element extending from said arm for receiving said released yarn.

4. An apparatus according to claim 1, wherein a plurality of said yarn receiving means are arranged adjacent to one another, and there are further provided a rail supporting said plurality of yarn receiving means and a rotatable shaft, said rail being integrally secured to said shaft such that movement of said yarn receiving means is effected in accordance with the rotational movement of said shaft.

5. An apparatus according to claim 2, wherein said fault detecting means comprises an arm the forward end of which constitutes a yarn receiving end and the backward of which constitutes a tension sensitive arm, a pin rotatably supporting said tension sensitive arm, a spring acting on said tension sensitive arm for opposing rotation thereof, and a microswitch disposed adjacent to said tension sensitive arm such that when abnormal yarn tension is applied to the arm, said tension sensitive arm is rotated against the force of said spring to actuate said microswitch and thereby to stop upward movement of said yarn receiving means.

6. An apparatus according to claim 1 further including guide means for positively directing the yarn released from the yarn engaging means to said yarn receiving means.

7. In a knitting machine having means engaging yarn fed to the knitting machine and releasing the yarn upon detecting of abnormal tension therein, an improved automatic yarn replacing apparatus comprising at least one yarn receiving means for receiving yarn released from the yarn engaging means and for returning the yarn thereto for reengagement, said yarn receiving means including yarn tension sensing means for blocking the operation of said yarn receiving means to return the yarn to the yarn engaging means when said tension sensing means detects an abnormal tension in the yarn, said yarn receiving means comprising a pivotal arm disposed below the yarn engaging means and movable between a raised and a lowered position, said arm normally being in said lowered position and being pivotable to said raised position, for reengaging the yarn with the yarn engaging means, said yarn tension sensing means comprising a biasing spring acting on said arm, and switch means which when closed prohibits an upward pivotal movement of the arm to its raised position and then returns the arm to the lowered position such that normally the arm is biassed by the spring to leave the switch means open, said arm closing said switch means under the action of abnormal tension in the yarn which overcomes the bias of the spring, and means for actuating yarn support elements of said yarn engaging means when the yarn receiving means are raised to the position that is suitable for said reengagement with the engaging means.

* * * * *